US007689428B2

(12) United States Patent
Takagi et al.

(10) Patent No.: US 7,689,428 B2
(45) Date of Patent: Mar. 30, 2010

(54) ACOUSTIC SIGNAL ENCODING DEVICE, AND ACOUSTIC SIGNAL DECODING DEVICE

(75) Inventors: Yoshiaki Takagi, Kanagawa (JP); Naoya Tanaka, Kanagawa (JP)

(73) Assignee: Panasonic Corporation, Osaka (JP)

( * ) Notice: Subject to any disclaimer, the term of this patent is extended or adjusted under 35 U.S.C. 154(b) by 321 days.

(21) Appl. No.: 11/577,151

(22) PCT Filed: Oct. 13, 2005

(86) PCT No.: PCT/JP2005/018885

§ 371 (c)(1),
(2), (4) Date: Nov. 28, 2007

(87) PCT Pub. No.: WO2006/041137

PCT Pub. Date: Apr. 20, 2006

(65) Prior Publication Data

US 2009/0030704 A1 Jan. 29, 2009

(51) Int. Cl.
*G10L 19/00* (2006.01)
*G10L 21/04* (2006.01)

(52) U.S. Cl. ..... 704/501; 704/206; 704/230; 704/503; 381/22; 381/23

(58) Field of Classification Search ..... None
See application file for complete search history.

(56) References Cited

U.S. PATENT DOCUMENTS 6,487,535 B1 * 11/2002 Smyth et al. ..... 704/500
6,961,432 B1 * 11/2005 Sinha et al. ..... 381/2
7,299,190 B2 * 11/2007 Thumpudi et al. ..... 704/500
7,450,727 B2 * 11/2008 Griesinger ..... 381/119
7,519,538 B2 * 4/2009 Villemoes et al. ..... 704/501
7,583,805 B2 * 9/2009 Baumgarte et al. ..... 381/61
2005/0058304 A1 * 3/2005 Baumgarte et al. ..... 381/98
2005/0195981 A1 * 9/2005 Faller et al. ..... 381/23
2006/0004583 A1 * 1/2006 Herre et al. ..... 704/500

FOREIGN PATENT DOCUMENTS

JP 6319200 11/1994

OTHER PUBLICATIONS

Faller, C. et al. "Binaural cue coding-Part II: schemes and applications," Speech and Audio Processing, IEEE Transactions on, pp. 520-531 Nov. 2003.*

(Continued)

*Primary Examiner*—Matthew J Sked
(74) *Attorney, Agent, or Firm*—Dickinson Wright, PLLC

(57) ABSTRACT

An acoustic signal encoding device for down-mixing at different ratios to encode a multichannel signal with a small number of channels, and an acoustic signal decoding device for decoding the signal encoded by the acoustic signal encoding device. In these devices, weighting means (103) in the acoustic signal encoding device (100) weights input signals of two channels individually according to a down-mixing coefficient thereby to calculate the level difference of the signals of two channels weighted by a level difference calculation unit (104). A separating unit (202) in the acoustic signal decoding device (200) separates the down-mixed signals into signals of two channels with the level difference information weighted.

4 Claims, 6 Drawing Sheets

OTHER PUBLICATIONS

Baumgarte, F. et al. "Estimation of auditory spatial cues for binaural cue coding," Acoustics, Speech, and Signal Processing, 2002. Proceedings. (ICASSP '02). IEEE International Conference on, pp. 1801-1804, 2002.*

PCT International Search Report dated Nov. 29, 2005 with English translation.

C. Faller, et al.: "Binaural Cue Coding Applied to Audio Compression with Flexible Rendering,"Proc. AES 113th Convention, Los Angeles, USA, Oct. 2002.

"Text of ISO/IEC 14496-3:2001/FPDAM2 (Parametric Audio),"International Organization for Standardisation, ISO/IEC JTC1/SC29/WG11, Coding of Moving Pictures and Audio, Thondheim, Norway, Jul. 2003, pp. i-v and 1-124.

* cited by examiner

ACOUSTIC SIGNAL ENCODING DEVICE, AND ACOUSTIC SIGNAL DECODING DEVICE

TECHNICAL FIELD

The present invention relates to an acoustic signal encoding apparatus which encodes a multichannel signal and an acoustic signal decoding apparatus which decodes a signal encoded by the acoustic signal encoding apparatus.

BACKGROUND ART

FIG. 1 is a block diagram showing the configurations of conventional acoustic signal encoding apparatus 10 and acoustic signal decoding apparatus 20. Here, the case will be described where multichannel signals are assumed to be two-channel signals and acoustic signal encoding apparatus 10 down-mixes the two-channel signals to one channel.

First, acoustic signal encoding apparatus 10 will be explained. In FIG. 1, down-mixing coefficient storage section 11 stores a down-mixing coefficient indicating a down-mixing ratio and outputs the down-mixing coefficient to down-mixing section 12.

Down-mixing section 12 mixes the input two-channel signals (multichannel signals) according to the down-mixing coefficient and thereby outputs the down-mixed signal as a one-channel down-mixed signal to multiplexing section 14.

Level difference calculation section 13 receives the same two-channel signals that have been inputted to down-mixing section 12 as input, calculates a level difference between the inputted two-channel signals and outputs the calculated level difference (level difference information) to multiplexing section 14.

Multiplexing section 14 multiplexes the one-channel down-mixed signal outputted from down-mixing section 12 with the level difference information outputted from level difference calculation section 13, forms a bit stream and outputs the formed bit stream from acoustic signal encoding apparatus 10.

Next, acoustic signal decoding apparatus 20 will be explained. In FIG. 1, demultiplexing section 21 extracts the down-mixed signal and the level difference information from the bit stream outputted from acoustic signal encoding apparatus 10 and outputs the extracted down-mixed signal and level difference information to separation section 22.

Separation section 22 forms two-channel signals from the one-channel down-mixed signal outputted from demultiplexing section 21 using the level difference information likewise outputted from demultiplexing section 21.

Here, separation section 22 is described as separating the signal into two-channel signals only using the level difference information, but it is possible to use correlation information and phase information of the two-channel signals in addition to the level difference information.

In this way, according to above-described acoustic signal encoding apparatus 10 and acoustic signal decoding apparatus 20, a multichannel signal can be encoded with a fewer number of channels (for example, see Non-Patent Document 1).

Non-Patent Document 1: "Text of ISO/IEC 14496-3:2001/FPDAM2 July, 2003 of (Parametric Audio)"

DISCLOSURE OF INVENTION

Problems to be Solved by the Invention

However, the above-described acoustic signal encoding apparatus and the acoustic signal decoding apparatus were proposed for the purpose of down-mixing a stereo signal to a monaural signal and presupposes that the mixing ratio of the two-channel signals to be down-mixed is 1:1. On the other hand, when a multichannel represented by a 5.1ch surround is down-mixed, it is recommended to down-mix two signals at a mixing ratio other than 1:1, for example, 1:0.7, and the above-described acoustic signal encoding apparatus and acoustic signal decoding apparatus cannot form the original multichannel signal correctly for such a down-mixed signal.

It is therefore an object of the present invention to provide an acoustic signal encoding apparatus which performs down mixing at different ratios and encodes a multichannel signal with a fewer number of channels and an acoustic signal decoding apparatus which decodes the signal encoded by the acoustic signal encoding apparatus.

Means for Solving the Problem

The acoustic signal encoding apparatus of the present invention adopts a configuration including: a down-mixing section that mixes signals of a plurality of channels into a one-channel down-mixed signal at a ratio indicated by a down-mixing coefficient, a level difference calculation section that calculates level difference information of the signals of the plurality of channels; a quantization section that quantizes the level difference information calculated by the level difference calculation section using a quantization characteristic that resolution decreases as the magnitude of the level difference information becomes remote from 0; and a multiplexing section that multiplexes the down-mixed signal mixed by the down-mixing section with the level difference information quantized by the quantization section and thereby forms a bit stream.

The acoustic signal decoding apparatus of the present invention adopts a configuration including: a demultiplexing section that extracts a down-mixed signal and quantization level difference information from a bit stream formed with a one-channel down-mixed signal in which signals of a plurality of channels are mixed at a ratio indicated by a down-mixing coefficient and level difference information obtained by quantizing level differences of the signals of the plurality of channels; a dequantization section that converts the quantization level difference information extracted by the demultiplexing section to level difference information before quantization; a weighting section that assigns weights to the level difference information converted by the dequantization section according to the down-mixing coefficient used for the formation of the bit stream; and a separation section that separates the down-mixed signal extracted by the demultiplexing section into a plurality of channels before mixing using the level difference information weighted by the weighting section.

The acoustic signal encoding method of the present invention includes the steps of: mixing signals of a plurality of channels into a one-channel down-mixed signal at a ratio indicated by a down-mixing coefficient; calculating level difference information of the signals of the plurality of channels; quantizing the level difference information using a quantization characteristic that resolution decreases as the magnitude of the level difference information becomes remote from 0; and multiplexing the mixed down-mixed signal with the quantized level difference information and thereby forming a bit stream.

ADVANTAGEOUS EFFECT OF THE INVENTION

The present invention can provide an acoustic signal encoding apparatus which performs down-mixing at different ratios and encodes a multichannel signal with a fewer number of channels and an acoustic signal decoding apparatus which decodes the signal encoded by the acoustic signal encoding apparatus.

BEST MODE FOR CARRYING OUT THE INVENTION

Figure 1:
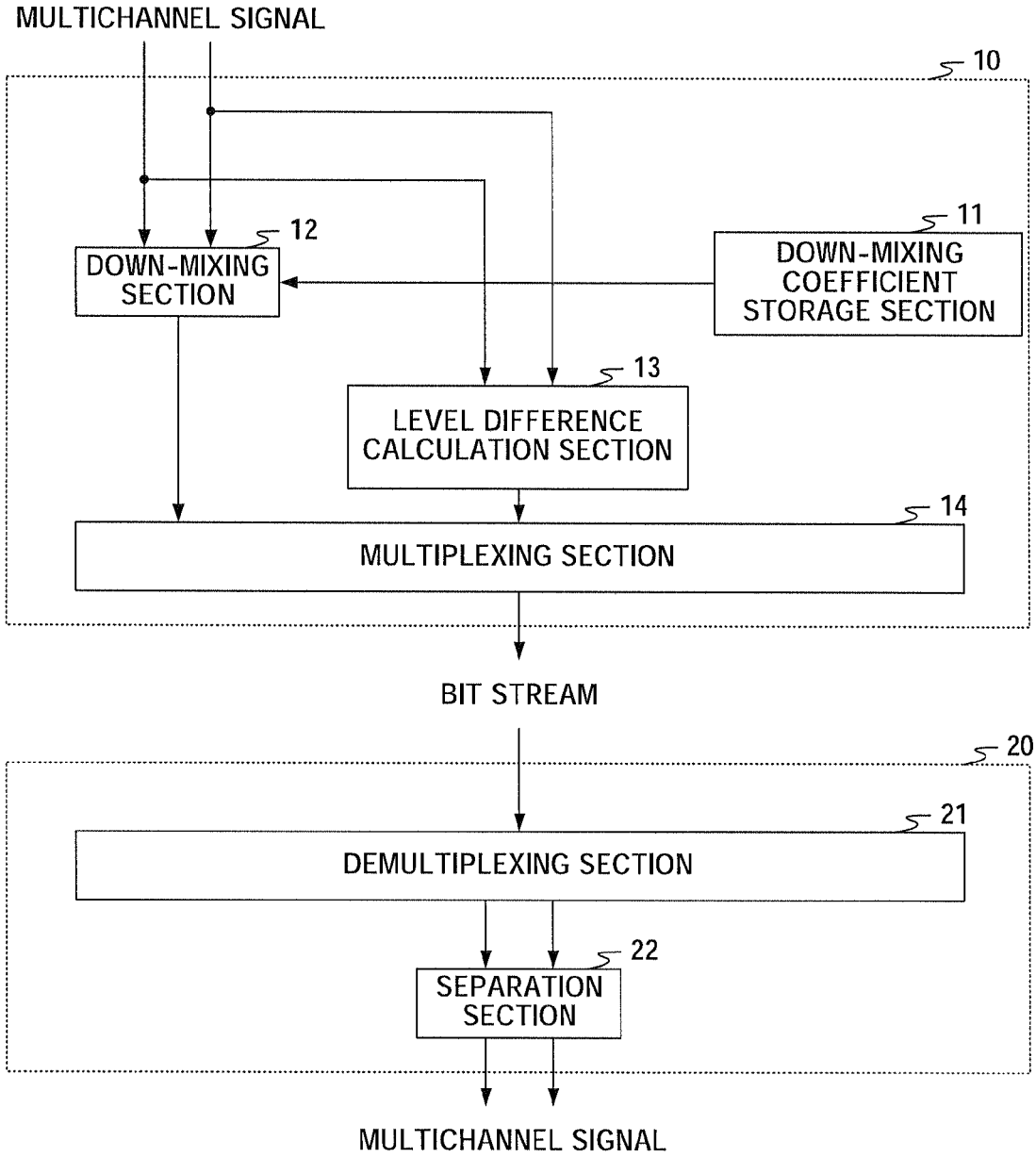
PRIOR ART FIG.1
FIG. 1 is a block diagram showing the configurations of a conventional acoustic signal encoding apparatus and acoustic signal decoding apparatus.

Hereinafter, embodiments of the present invention will be explained with reference to the attached drawings in detail. Components that have identical functions will be assigned the same reference numerals without further explanations.

Embodiment 1

Figure 2:
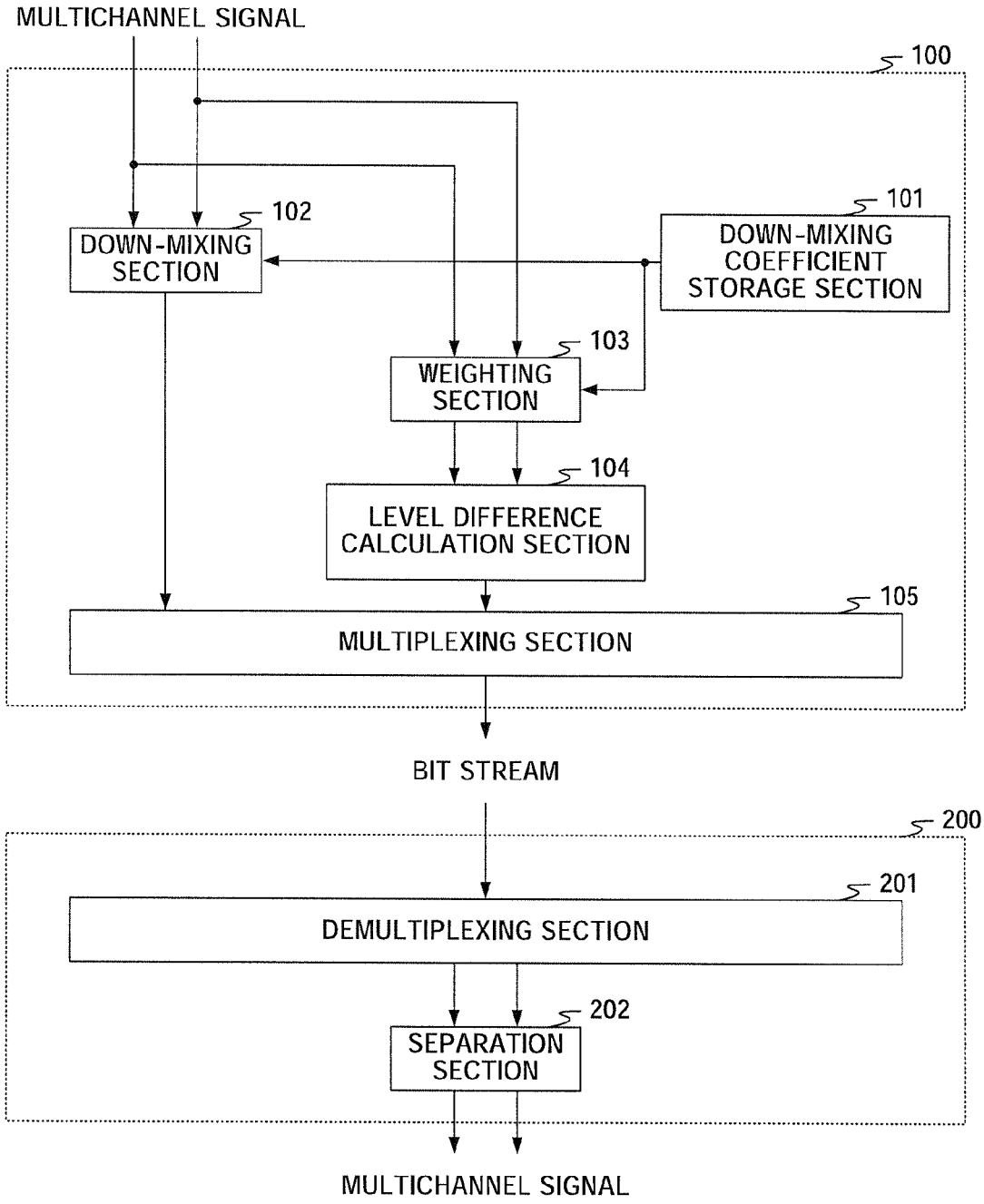
FIG. 2 is a block diagram showing the configurations of an acoustic signal encoding apparatus and an acoustic signal decoding apparatus according to Embodiment 1 of the present invention.

FIG. 2 shows the configurations of acoustic signal encoding apparatus 100 and acoustic signal decoding apparatus 200 according to Embodiment 1 of the present invention. Here, a case will be described where two-channel signals are used for multichannel signals and acoustic signal encoding apparatus 100 down-mixes the two-channel signals into one channel.

First, acoustic signal encoding apparatus 100 will be explained. In FIG. 2, down-mixing coefficient storage section 101 stores a down-mixing coefficient indicating a down-mixing ratio, and the down-mixing coefficient is outputted to down-mixing section 102 and weighting section 103.

Down-mixing section 102 mixes inputted two-channel signals (multichannel signals) according to the down-mixing coefficient from down-mixing coefficient storage section 101 to form a one-channel down-mixed signal and outputs the down-mixed signal to multiplexing section 105.

Weighting section 103 receives the same two-channel signals that have been inputted to down-mixing section 102 as input and assigns weights to the levels of the inputted two-channel signals according to the down-mixing coefficient. The weighted two-channel input signals are outputted to level difference calculation section 104.

Level difference calculation section 104 calculates a level difference of the weighted two-channel signals and outputs the calculated level difference (level difference information) to multiplexing section 105.

Multiplexing section 105 multiplexes the one-channel down-mixed signal outputted from down-mixing section 102 with the level difference information outputted from level difference calculation section 104 to form a bit stream and outputs the formed bit stream from acoustic signal encoding apparatus 100.

Next, acoustic signal decoding apparatus 200 will be explained. In FIG. 2, demultiplexing section 201 extracts the down-mixed signal and the level difference information from the bit stream outputted from acoustic signal encoding apparatus 100 and outputs the extracted down-mixed signal and level difference information to separation section 202.

Separation section 202 forms two-channel signals from the one-channel down-mixed signal outputted from demultiplexing section 201 using the level difference information likewise outputted from demultiplexing section 201.

Next, the operations of acoustic signal encoding apparatus 100 and acoustic signal decoding apparatus 200 having the above-described configurations will be explained. First, the two-channel signals inputted to acoustic signal encoding apparatus 100 are mixed at down-mixing section 102 into a one-channel signal at a mixing ratio of the down-mixing coefficient stored in down-mixing coefficient storage section 101. At this time, the down-mixed signal can also be compressed and encoded, but detailed explanations thereof will be omitted here. The down-mixed signals mixed into one channel are outputted to multiplexing section 105.

Figure 3:
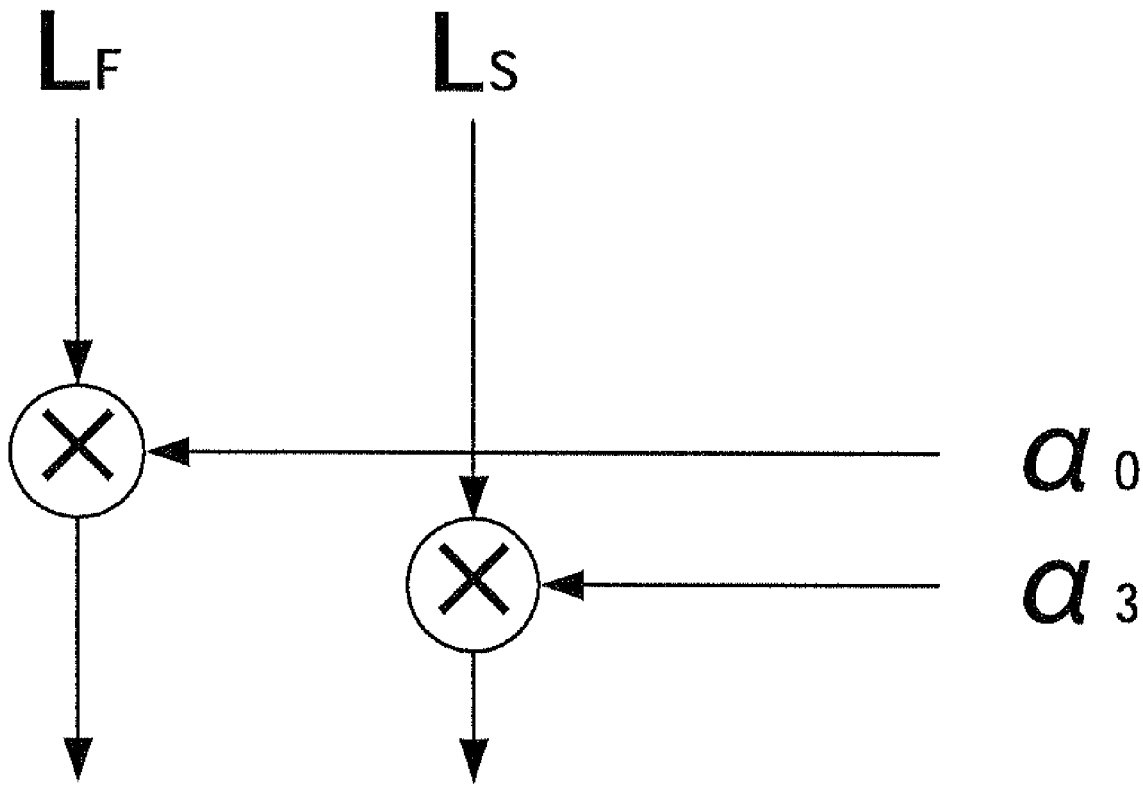
FIG. 3 shows the configuration of a weighting section.

Furthermore, as shown in FIG. 3, two-channel signals LF and LS inputted to acoustic signal encoding apparatus 100 are weighted by weighting section 103 according to down-mixing coefficients $\alpha 0$ and $\alpha 3$ stored in down-mixing coefficient storage section 101, and thereby the levels thereof are changed, and the two-channel signals whose levels have been changed are outputted to level difference calculation section 104. Even when the down-mixing coefficient is a mixing ratio other than 1:1, for example, $1:\sqrt{2}$, the levels of the two-channel signals can be set to levels according to the mixing ratio. Furthermore, when signals having more than two channels are down-mixed, this can be realized by repeating down-mixing of two channels to one channel.

The level difference of the weighted two-channel signals is calculated by level difference calculation section 104, and the calculated level difference is outputted to multiplexing section 105.

The down-mixed signal outputted from down-mixing section 102 and the level difference information outputted from level difference calculation section 104 are multiplexed by multiplexing section 105 and outputted as a bit stream.

The bit stream inputted to acoustic signal decoding apparatus 200 is separated into the down-mixed signal and the level difference information at demultiplexing section 201. The separated down-mixed signal is separated into two-channel signals based on the separated level difference information at separation section 202. By using information such as cross-correlation and a phase difference of the two-channel signals in addition to the level difference information at this time, the accuracy of separation section 202 can be improved. Calculation examples of the separation processing are shown below.

$$L=M*10\hat{}(\text{energy_dB}-ILD/2)$$

$$R=M'*10\hat{}(\text{energy_dB}+ILD/2)$$

Here, L is the separated left channel signal, R is the separated right channel signal, M is a down-mixed signal, M' is a pseudo signal generated from the down-mixed signal, energy_dB is energy of the down-mixed signal, and ILD is level difference information.

According to Embodiment 1 in this way, the acoustic signal encoding apparatus assigns weights to two-channel input signals according to a down-mixing coefficient, calculates the level difference of the weighted two-channel signals, and thereby, even when down-mixing is performed at a mixing ratio other than 1:1, it is possible to prevent the mixing ratio of the down-mixing ratio coefficient from superimposing on the level difference of the output signal at the acoustic signal decoding apparatus and prevent a shift in the level difference from occurring.

Embodiment 2

Figure 4:
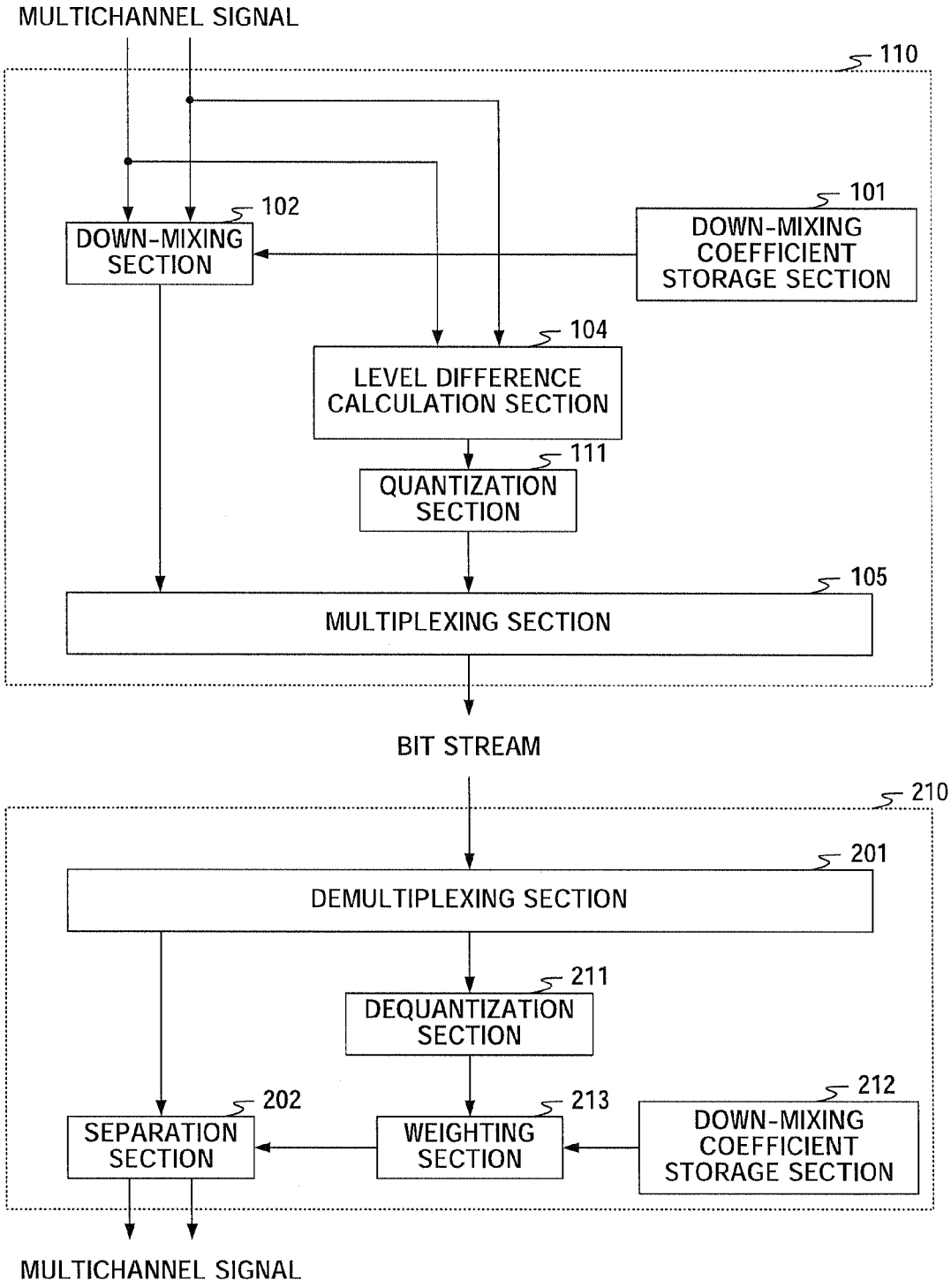
FIG. 4 is a block diagram showing the configurations of an acoustic signal encoding apparatus and an acoustic signal decoding apparatus according to Embodiment 2.

FIG. 4 is a block diagram showing the configurations of acoustic signal encoding apparatus 110 and acoustic signal decoding apparatus 210 according to Embodiment 2 of the present invention. In this figure, level difference calculation section 104 of acoustic signal encoding apparatus 110 receives two-channel signals which are the same as the signals inputted to down-mixing section 102 as input, calculates a level difference of the input two-channel signals and outputs the calculated level difference (level difference information) to quantization section 111.

Figure 5:
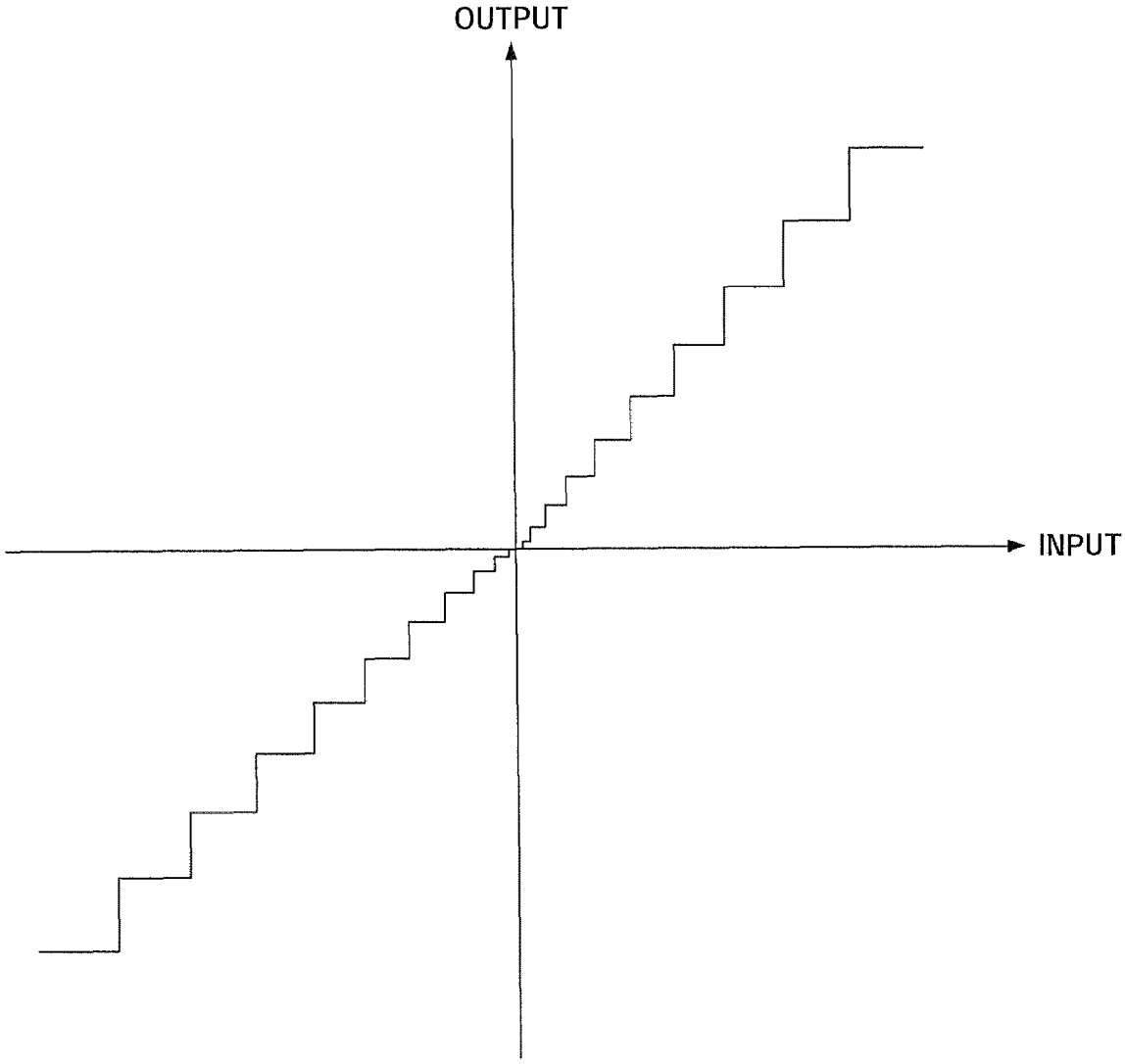
FIG. 5 shows a quantization step.

As shown in FIG. 5, quantization section 111 has a quantization characteristic of quantizing with high resolution in an area where the magnitude of the level difference information (inputted) outputted from level difference calculation section 104 is near 0 and quantizing with low resolution as the magnitude of the level difference information becomes remote from 0. The level difference information outputted from level difference calculation section 104 is quantized and thereby compressed, and the quantization level difference information is outputted to multiplexing section 105.

Demultiplexing section 201 in acoustic signal decoding apparatus 210 extracts a down-mixed signal and quantization level difference information from the input bit stream, outputs the down-mixed signal to separation section 202 and outputs the quantization level difference information to dequantization section 211.

Dequantization section 211 converts the quantization level difference information outputted from demultiplexing section 201 to level difference information and outputs the level difference information to weighting section 213.

Down-mixing coefficient storage section 212 stores a down-mixing coefficient which is the same as the down-mixing coefficient stored in the down-mixing coefficient storage section 101 of acoustic signal encoding apparatus 110 and outputs the stored down-mixing coefficient to weighting section 213.

Weighting section 213 assigns weights to the level difference information outputted from dequantization section 211 according to the down-mixing coefficient outputted from down-mixing coefficient storage section 212 and outputs the weighted level difference information to separation section 202.

Next, the operations of acoustic signal encoding apparatus 110 and acoustic signal decoding apparatus 210 having the above-described configuration will be explained. The level difference information of the two-channel signals inputted to acoustic signal encoding apparatus 110 is calculated by level difference calculation section 104, and the calculated level difference information is quantized by quantization section 111.

The down-mixed signal and quantized level difference information are multiplexed by multiplexing section 105 and outputted as a bit stream.

The bit stream inputted to acoustic signal decoding apparatus 210 is separated into the down-mixed signal and the quantization level difference information by demultiplexing section 201, and the down-mixed signal is outputted to separation section 202, and the quantization level difference information is outputted to dequantization section 211.

The quantization level difference information is converted to level difference information before quantization by dequantization section 211 and the converted level difference information is corrected by being weighted according to the down-mixing coefficient which is the same as the down-mixing coefficient used by acoustic signal encoding apparatus 110 at weighting section 213. A calculation example of the weighting processing is shown below.

$$ILD = ILD_org + 20 * \log(\alpha 0/\alpha 3)$$

Here, ILD is level difference information used in separation processing, ILD_org is the dequantized level difference information, and $\alpha 0$ and $\alpha 3$ are down-mixing coefficients.

The down-mixed signal is separated into two-channel signals based on the level difference information corrected at separation section 202. A calculation example of the separation processing is shown below.

$$L = M' * 10\hat{}(\text{energy_dB} - ILD/2)$$

$$R = M'' * 10\hat{}(\text{energy_dB} + ILD/2)$$

Here, L is a separated left channel signal, R is a separated right channel signal, M is a down-mixed signal, M' is a pseudo signal generated from the down-mixed signal, energy_dB is energy of the down-mixed signal and ILD is level difference information.

Here, assuming a case where acoustic signal encoding apparatus 100 shown in FIG. 2 is provided with quantization section 111, when down-mixing is performed at a mixing ratio other than 1:1, weighting section 103 performs weighting according to the down-mixing coefficient, and therefore the level difference increases, and it is necessary to realize quantization with low resolution.

On the other hand, in this embodiment, weights are not assigned to the inputted two-channel signals, and acoustic signal decoding apparatus 210 assigns weights according to the down-mixing coefficient after the dequantization processing, and thereby it is possible to perform quantization with high resolution, and, even when down-mixing is performed at a mixing ratio other than 1:1, prevent the mixing ratio of the down-mixing coefficient from superimposing on the level difference of the output signal at acoustic signal decoding apparatus 210 and thereby prevent a shift from occurring in the level difference.

In this way, according to Embodiment 2, the acoustic signal encoding apparatus quantizes the level difference information of the input two-channel signals using a quantization characteristic of quantizing with high resolution in an area where the magnitude of the level difference information is near 0 and quantizing with low resolution as the magnitude of the level difference information becomes remote from 0, and the acoustic signal decoding apparatus converts the quantized level difference information to level difference information before quantization, corrects the converted level difference information according to the down-mixing coefficient used by the acoustic signal encoding apparatus, and can thereby reduce deterioration of the level difference information due to the quantization.

Embodiment 3

Figure 6:
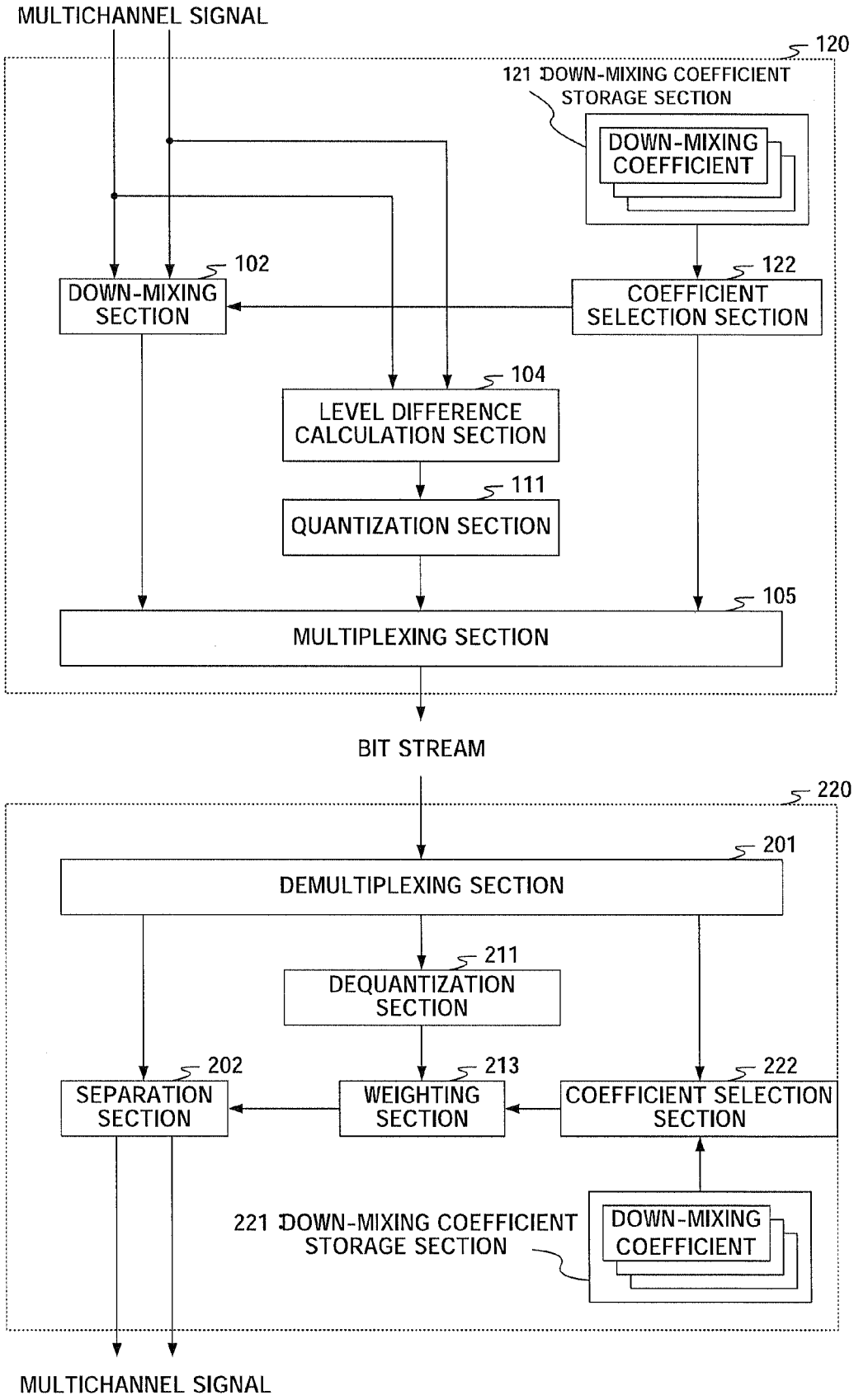
FIG. 6 is a block diagram showing the configurations of an acoustic signal encoding apparatus and an acoustic signal decoding apparatus according to Embodiment 3.

FIG. 6 is a block diagram showing the configurations of acoustic signal encoding apparatus 120 and acoustic signal decoding apparatus 220 according to Embodiment 3 of the present invention. In this figure, down-mixing coefficient storage section 121 in acoustic signal encoding apparatus 120 stores a plurality of down-mixing coefficients indicating a plurality of different mixing ratios.

Coefficient selection section 122 selects a down-mixing coefficient to be used from a plurality of down-mixing coefficients stored in down-mixing coefficient storage section 121, outputs the selected down-mixing coefficient to down-mixing section 102 and outputs the coefficient selection information showing the selected down-mixing coefficient to multiplexing section 105.

Multiplexing section 105 multiplexes one-channel down-mixed signal outputted from down-mixing section 102, quantization level difference information outputted from quantization section 111 and the coefficient selection information outputted from coefficient selection section 122 to form a bit stream and outputs the formed bit stream from acoustic signal encoding apparatus 120.

Demultiplexing section 201 in acoustic signal decoding apparatus 220 extracts a down-mixed signal, quantization level difference information and coefficient selection information from the inputted bit stream, outputs the down-mixed signal to separation section 202, outputs the quantization level difference information to dequantization section 211 and outputs the coefficient selection information to coefficient selection section 222.

Down-mixing coefficient storage section 221 stores a plurality of down-mixing coefficients which are the same as the down-mixing coefficients stored in down-mixing coefficient storage section 121 in acoustic signal encoding apparatus 120.

Coefficient selection section 222 selects a down-mixing coefficient from down-mixing coefficient storage section 221 based on the coefficient selection information outputted from demultiplexing section 201 and outputs the selected down-mixing coefficient to weighting section 213.

Next, the operations of acoustic signal encoding apparatus 120 and acoustic signal decoding apparatus 220 in the above-described configuration will be explained. First, coefficient selection section 122 selects a down-mixing coefficient to be used from down-mixing coefficient storage section 121. The following expression is an example of down-mixing.

$$Lmix=\alpha 0*Lf\pm\alpha 1*Rf\pm\alpha 2*C\pm\alpha 3*Ls\pm\alpha 4*Rs\pm\alpha 5*LFE$$

$$Rmix=\beta 1*Rf\pm\beta 0*Lf\pm\beta 2*C\pm\beta 3*Ls\pm\beta 4*Rs\pm\beta 5*LFE$$

In the above-described expressions, Lmix is a down-mixed left channel signal, Rmix is a down-mixed right channel signal, Lf is a left forward channel signal, Rf is a right forward channel signal, C is a center channel signal, Ls is a left backward channel signal, Rs is a right backward channel signal, LFE is a subwoofer channel signal and $\alpha 0$, $\alpha 1$, $\alpha 2$, $\alpha 3$, $\alpha 4$, $\alpha 5$, $\beta 0$, $\beta 1$, $\beta 2$, $\beta 3$, $\beta 4$ and $\beta 5$ are down-mixing coefficients.

ITU defines the following coefficients as examples of the down-mixing coefficients.

$\alpha 0=0.5$
$\alpha 1=0$
$\alpha 2=0.5/\sqrt{2}$
$\alpha 3=0.5/\sqrt{2}$
$\alpha 4=0$
$\alpha 5=0$
$\beta 0=0$
$\beta 1=0.5$
$\beta 2=0.5/\sqrt{2}$
$\beta 3=0$
$\beta 4=0.5/\sqrt{2}$
$\beta 5=0$ The above-described coefficients are merely examples, and various coefficients are defined and used by down-mixing operators.

The two-channel signals inputted to acoustic signal encoding apparatus 120 are mixed into a one-channel signal by down-mixing section 102 at a mixing ratio of the down-mixing coefficient selected by coefficient selection section 122.

On the other hand, level difference information of the two-channel signals inputted to acoustic signal encoding apparatus 120 is calculated by level difference calculation section 104 and the calculated level difference information is quantized by quantization section 111.

The down-mixed signal, quantization level difference information and coefficient selection information are multiplexed by multiplexing section 105 and outputted as a bit stream.

The bit stream inputted to acoustic signal decoding apparatus 220 is separated into the down-mixed signal, the quantization level difference information and the coefficient selection information by demultiplexing section 201.

Coefficient selection section 222 selects a down-mixing coefficient which is the same as the down-mixing coefficient used by acoustic signal encoding apparatus 120 from down-mixing coefficient storage section 221 based on the coefficient selection information.

Quantization level difference information is converted to level difference information before quantization by dequantization section 211. The converted level difference information is corrected by being weighted according to the down-mixing coefficient selected by coefficient selection section 222 at weighting section 213.

The down-mixed signal is separated into the two-channel signals based on the corrected level difference information at separation section 202.

According to Embodiment 3 in this way, the acoustic signal encoding apparatus mixes the two-channel signals into one channel with the down-mixing coefficient selected from a plurality of different down-mixing coefficients, reports the selected down-mixing coefficient to the acoustic signal decoding apparatus, and the acoustic signal decoding apparatus corrects the level difference information according to the reported down-mixing coefficient, and can thereby prevent the mixing ratio of the down-mixing coefficient from superimposing on the level difference of the output signal at the acoustic signal decoding apparatus even when a plurality of down-mixing coefficients are used, and thereby prevent a shift in the level difference from occurring.

In this embodiment, the case has been explained as an example where coefficient selection information is transmitted, but the present invention is not limited to this, and the selected down-mixing coefficient itself may also be transmitted, and in this case, the acoustic signal decoding apparatus need not have the plurality of down-mixing coefficients and the coefficient selection section.

A first aspect of the present invention is an acoustic signal encoding apparatus including: a down-mixing section that mixes input signals of a plurality of channels into a one-channel down-mixed signal at a mixing ratio indicated by a down-mixing coefficient; a weighting section that assigns weights to the levels of the input signals of the plurality of channels according to the down-mixing coefficient; a level difference calculation section that calculates level differences of the signals of the plurality of channels weighted by the weighting section; and a multiplexing section that multiplexes the down-mixed signal mixed by the down-mixing section with the level difference information calculated by the level difference calculation section and thereby forms a bit stream.

According to this configuration, the levels of the inputted signals of the plurality of channels are weighted according to the down-mixing coefficient, and, even when down-mixing is performed at a mixing ratio of 1:1, it is possible to reflect a mixing ratio other than 1:1 in the level differences of the signals of the plurality of channels, and the acoustic signal decoding apparatus can thereby prevent the mixing ratio of the down-mixing coefficient from superimposing on the level difference of the output signal.

A second aspect of the present invention is an acoustic signal encoding apparatus including: a down-mixing section that mixes input signals of a plurality of channels into a one-channel down-mixed signal at a mixing ratio indicated by a down-mixing coefficient; a level difference calculation section that calculates level differences of the input signals of the plurality of channels; a quantization section that quantizes the level difference information calculated by the level difference calculation section using a quantization characteristic that resolution decreases as the magnitude of the level difference information becomes remote from 0; and a multiplexing section that multiplexes the down-mixed signal mixed by the down-mixing section with the level difference information quantized by the quantization section and thereby forms a bit stream.

A third aspect of the present invention is an acoustic signal decoding apparatus including: a demultiplexing section that extracts a down-mixed signal and quantization level difference information from a bit stream formed with a one-channel down-mixed signal in which input signals of a plurality of channels are mixed at a mixing ratio indicated by a down-mixing coefficient and level difference information obtained by quantizing level differences of the input signals of the plurality of channels; a dequantization section that converts the quantization level difference information extracted by the demultiplexing section to level difference information before quantization; a weighting section that assigns weights to the level difference information converted by the dequantization section according to the down-mixing coefficient used for the formation of the bit stream; and a separation section that separates the down-mixed signal extracted by the demultiplexing section into a plurality of channels before mixing using the level difference information weighted by the weighting section.

According to these configurations, even when the acoustic signal encoding apparatus quantizes the level difference information using the quantization characteristic that resolution decreases as the magnitude of the level difference information becomes remote from 0, the acoustic signal decoding apparatus assigns weights according to the down-mixing coefficient after the dequantization processing, and can thereby reduce deterioration of the level difference information due to quantization.

A fourth aspect of the present invention is the acoustic signal encoding apparatus in the above-described aspect further including a coefficient selection section that has a plurality of different down-mixing coefficients and selects any down-mixing coefficient, wherein the multiplexing section multiplexes coefficient selection information indicating the down-mixing coefficient selected by the coefficient selection section.

A fifth aspect of the present invention is an acoustic signal decoding apparatus including: a demultiplexing section that extracts a down-mixed signal, quantization level difference information and coefficient selection information from a bit stream formed with a one-channel down-mixed signal in which inputted signals of a plurality of channels are mixed at a mixing ratio indicated by a selected down-mixing coefficient, level difference information obtained by quantizing level differences of the input signals of the plurality of channels and coefficient selection information indicating the selected down-mixed coefficient; a dequantization section that converts the quantization level difference information extracted by the demultiplexing section to level difference information before quantization; a coefficient selection section that has a plurality of different down-mixing coefficients and selects a down-mixing coefficient based on the coefficient selection information extracted by the demultiplexing section; a weighting section that assigns weights to the level difference information converted by the dequantization section according to the down-mixing coefficient selected by the coefficient selection section; and a separation section that separates the down-mixed signal extracted by the demultiplexing section into a plurality of channels before mixing using the level difference information weighted by the weighting section.

According to these configurations, even when the acoustic signal encoding apparatus uses a plurality of down-mixing coefficients, it is possible to prevent the mixing ratio of any down-mixing coefficient from superimposing on the level difference of the output signal of the acoustic signal decoding apparatus.

A sixth aspect of the present invention is an acoustic signal encoding method including the steps of: mixing input signals of a plurality of channels into a one-channel down-mixed signal at a mixing ratio indicated by a down-mixing coefficient; assigning weights to the levels of the input signals of the plurality of channels according to the down-mixing coefficient; calculating level differences of the weighted signals of the plurality of channels; and multiplexing the mixed down-mixed signal and the calculated level difference information and thereby forming a bit stream.

According to this method, the levels of the inputted signals of the plurality of channels are weighted according to the down-mixing coefficient, and, even when down-mixing is performed at a mixing ratio other than 1:1, it is possible to reflect the mixing ratio other than 1:1 in the level differences of the signals of the plurality of channels, so that the acoustic signal decoding apparatus can prevent the mixing ratio of the down-mixing coefficient from superimposing on the level difference of the output signal.

The present application is based on Japanese Patent Application No. 2004-300441, filed on Oct. 14, 2004, the entire content of which is expressly incorporated by reference herein.

INDUSTRIAL APPLICABILITY

The acoustic signal encoding apparatus according to the present invention performs down-mixing at different ratios and has the effect of encoding a multichannel signal with a fewer number of channels and is applicable to a portable apparatus or the like which needs to be downsized, and the acoustic signal decoding apparatus according to the present invention has the effect of decoding signals encoded by the acoustic signal encoding apparatus and is applicable to a portable apparatus or the like which needs to be downsized.

The invention claimed is:

1. An acoustic signal encoding apparatus comprising:

a down-mixing section that mixes signals of a plurality of channels into a one-channel down-mixed signal at a ratio indicated by a down-mixing coefficient;

a level difference calculation section that calculates level difference information of the signals of the plurality of channels;

a quantization section that quantizes the level difference information calculated by the level difference calculation section using a quantization characteristic that resolution decreases as the magnitude of the level difference information becomes remote from 0; and a multiplexing section that multiplexes the down-mixed signal mixed by the down-mixing section with the level difference information quantized by the quantization section and thereby forms a bit stream.

2. The acoustic signal encoding apparatus according to claim 1, further comprising a coefficient selection section that selects any down-mixing coefficient out of the plurality of different down-mixing coefficients, wherein the multiplexing section multiplexes the coefficient selection information indicating the down-mixing coefficient selected by the coefficient selection section.

3. An acoustic signal decoding apparatus comprising:

a demultiplexing section that extracts a down-mixed signal and quantization level difference information from a bit stream formed with a one-channel down-mixed signal in which signals of a plurality of channels are mixed at a ratio indicated by a down-mixing coefficient and level difference information obtained by quantizing level differences of the signals of the plurality of channels;

a dequantization section that converts the quantization level difference information extracted by the demultiplexing section to level difference information before quantization;

a weighting section that assigns weights to the level difference information converted by the dequantization section according to the down-mixing coefficient used for the formation of the bit stream; and a separation section that separates the down-mixed signal extracted by the demultiplexing section into a plurality of channels before mixing using the level difference information weighted by the weighting section.

4. An acoustic signal encoding method comprising the steps of:

mixing signals of a plurality of channels into a one-channel down-mixed signal at a ratio indicated by a down-mixing coefficient;

calculating level difference information of the signals of the plurality of channels;

quantizing the level difference information using a quantization characteristic that resolution decreases as the magnitude of the level difference information becomes remote from 0; and multiplexing the mixed down-mixed signal with the quantized level difference information and thereby forming a bit stream.

* * * * *

UNITED STATES PATENT AND TRADEMARK OFFICE

CERTIFICATE OF CORRECTION

PATENT NO. : 7,689,428 B2
APPLICATION NO. : 11/577151
DATED : March 30, 2010
INVENTOR(S) : Yoshiaki Takagi et al.

It is certified that error appears in the above-identified patent and that said Letters Patent is hereby corrected as shown below:

On the title page:

Item 30, Foreign Application Priority Data, insert:

--October 14, 2004 (JP) ..... 2004-300441--

Signed and Sealed this

Fourteenth Day of September, 2010

David J. Kappos

David J. Kappos
*Director of the United States Patent and Trademark Office*